US005099822A

United States Patent [19]

Cramer et al.

[11] Patent Number: 5,099,822

[45] Date of Patent: Mar. 31, 1992

[54] COOKING APPARATUS WITH AT LEAST ONE GLASS-CERAMIC COOKING PLATE

[75] Inventors: Wilhelm Cramer, Sundern; Dietmar Kaselow, Hemer, both of Fed. Rep. of Germany

[73] Assignee: Cramer GmbH & Co. Kommanditgesellschaft, Menden, Fed. Rep. of Germany

[21] Appl. No.: 652,028

[22] Filed: Feb. 7, 1991

[30] Foreign Application Priority Data

Feb. 8, 1990 [DE] Fed. Rep. of Germany ..... 4003799

[51] Int. Cl.[5] ..... F24C 3/00

[52] U.S. Cl. ..... 126/39 BA; 126/39 J; 126/39 E; 431/48; 431/60; 431/74

[58] Field of Search ..... 126/39 R, 39 J, 39 E, 126/39 G, 39 BA; 431/74, 25, 78, 71, 46, 75, 43, 48, 60

[56] References Cited

U.S. PATENT DOCUMENTS

| | | | |
|---|---|---|---|
| 2,640,920 | 6/1953 | Cairns, Jr. | 431/25 |
| 2,735,483 | 2/1956 | Brodbeck et al. | 431/74 |
| 3,196,928 | 7/1965 | La Pointe et al. | 431/74 |
| 3,734,681 | 5/1973 | Perl | 126/39 J |
| 4,130,104 | 12/1978 | Kristen et al. | 126/39 J |

FOREIGN PATENT DOCUMENTS 2641274 3/1976 Fed. Rep. of Germany .

*Primary Examiner*—James C. Yeung
*Attorney, Agent, or Firm*—Herbert Dubno

[57] ABSTRACT

A cooking range in which a burner below a glass-ceramic plate is ignited with a glow igniter switched off in response to an ionization detector when combustion products are effected so as to prevent excessive heating of the glow igniter.

2 Claims, 2 Drawing Sheets

COOKING APPARATUS WITH AT LEAST ONE GLASS-CERAMIC COOKING PLATE

FIELD OF THE INVENTION

Our present invention relates to a cooking apparatus or stove having a glass-ceramic cooking surface and, more particularly, to a glass stove of the type in which one or more burners are disposed below a glass-ceramic surface which is heated by the combustion of gas below the glass-ceramic plate so that pots or the like placed on the glass-ceramic plate are heated in turn.

BACKGROUND OF THE INVENTION

Modern cooking appliances, especially stoves, may conceal the burners beneath a glass-ceramic plate which is heated by the combustion of gas below the plate so that pots or the like placed upon the glass-ceramic plate will be heated for cooking and other purposes.

For this purpose, below the glass-ceramic plate, a gas jet burner can be provided with a nozzle plate from which gas jets emerge and are burned, the burner distributing the gas to the orifices of the plate.

The apparatus generally comprises, as well, an igniter for initiating the combustion of the gas jets, a supply of the fuel gas and a magnetic valve for controlling the feed of the gas to the burner. In addition, it is customary to provide a control arrangement allowing the gas supply to be turned on and off and a monitoring device for monitoring the operation of the gas burner, for example, to shut down the gas supply should the flame be extinguished for any length of time or should the ignition fail.

Reference may be had to the commonly assigned U.S. Pat. No. 4,830,602 which describes a gas range having at least one burner covered by a glass-ceramic plate forming the cooking field. The cooking burner which is commonly used to ignite the main burner of conventional cooking units of this type is generally positioned sufficiently close to the main burner that a reliable ignition can be ensured.

For the most part, such a gas range can have a plurality of cooking fields, i.e. zones of the glass-ceramic plate at which cooking can occur and each of which can be provided with a respective burner below the glass-ceramic plate. These burners are supplied in an electrotechnical sense, in parallel. The burner may have a surface screen or display indicating the status of the burners.

In an earlier cooking apparatus or range of this type, for example, the range described in German patent document DE 26 41 274, a glow igniter is provided and is integrated in the monitoring unit so that it is constantly energized. Under these circumstances, a failure to ignite the main burner can occur only when the glow igniter itself fails to operate properly.

To monitor for failures, a special monitoring unit is provided which is associated with a safety magnetic valve shutting down the gas feed to the main burner when the current supplied to the glow igniter is detected to fail. A system of this type is comparatively expensive since it requires a special safety magnetic valve in addition to the main control valve.

For the most part, the reliability of the gas range depends largely upon the reliability of the safety magnetic valve. This cannot always be ensured.

Furthermore, since the glow igniter is constantly energized in such systems, the glow igniter operates at a higher temperature than would be the case if the glow igniter were to be intermittently energized and this continuously higher operating temperature has been found to decrease the useful life of the glow igniter. A premature failure of the glow igniter, moreover, may render the range completely or partially inoperative.

An advantage of this system, however, is that the glow igniter ensures uniform ignition without explosions or the like. By contrast, other range designs known to the art, utilizing, for example, spark ignition or high-voltage ignition, give rise to nonuniform ignition and detrimental explosions. High-voltage systems, moreover, have been found to be environmentally unsound since they create radio and television interference which cannot be readily supervised.

OBJECTS OF THE INVENTION

It is, therefore, the principal object of the present invention to provide a cooking range of the type described which has a simpler control and monitoring system and greater reliability than earlier range systems.

A more specific object of the invention is to provide a range of the type in which the advantages of a glow-type ignition without explosion can be obtained but without drawbacks of earlier glow-type ignition systems with respect to the short useful life of the glow igniter.

It is also an object of the invention to provide a relatively low-cost control system for a gas burner below a glass-ceramic plate which eliminates the need for a special safety valve in addition to the main gas valve.

A further object of the invention is to provide a system for a gas range of the glass-ceramic cooking field type which is free from drawbacks such as nonuniform ignition and expensive ignition, but which is not environmentally problematical, i.e. does not cause radio and television interference.

SUMMARY OF THE INVENTION

These objects and others which will become apparent hereinafter are attained, in accordance with the present invention, in a cooking apparatus or range having at least one glass-ceramic cooking field in the form of a glass-ceramic plate below which at least one gas jet burner is provided and, in close proximity thereto, having a glow-type igniter. The control and monitoring system of the invention comprises an ionization stretch which responds to ionization in the combustion gases resulting from the combustion of the fuel gas jets from the burner.

The glow igniter is connected in a glow igniter electrical circuit which can be switched on and off with the on and off switching device for the electromagnetic valve supplying fuel gas to the burner.

The glow-igniter circuit is interruptible by the monitoring device when the ionization circuit is activated in accordance with an essential feature of the invention.

While flame monitoring utilizing the so-called ionization principle and an ionization stretch is itself known, as far as we are aware, this system is utilized only in conjunction with high-voltage ignition with all of the drawbacks thereof.

In the system of the present invention, a flame monitoring by the ionization principle is combined with glow ignition in a unique manner. Since the glow igniter is cut off by the control effected by the ionization stretch as soon as the associated gas jet burner is ignited, the temperature of the glow igniter is lowered in spite of its presence in the region of the gas jet burner. The useful life of the glow igniter is increased substantially since the glow igniter is only switched on for a brief fraction of the total time for which the glass-ceramic cooking field is used. With the increased life of the glow igniter, the overall utility of the gas range is increased and the gas range is made more reliable.

A glow igniter, as long as it is energized, draws a relatively high amount of electrical energy so that, at the voltages at which the cooking apparatus is usually operated, the current draw of the system is comparatively high.

This, of course, means that the current source supplying the cooking apparatus must be correspondingly dimensioned to supply the relatively high electrical demand. This is especially a problem when the cooking apparatus has a multiplicity of glass-ceramic fields, i.e. a plurality of burners below the glass-ceramic cooking plate.

In that case, should a number of burners be turned on simultaneously and each be associated with a high-current-demand counter which must be continuously left on, the total current draw of the system will be extremely great.

According to the invention, this problem can be overcome and the cooking range can be operated with a current source with a comparatively low power by providing separate magnetic valves for the gas feeds to the respective burners of the plurality of glass-ceramic cooking fields. The control device then can be provided with a sequencing control for the gas jet burners so that upon simultaneous activation of the controller which turns on a plurality of burners and the respective magnetic valves, the glow igniters for the individual glass-ceramic cooking fields are controlled so that first one and then another will be energized and the previously energized igniter turned off.

More specifically, the $n^{th}$ igniter will be energized only after the $(n-1)^{th}$ igniter has completed ignition and upon off, n being an integer greater than 1, i.e. $n=2$, $n=3$ . . . In the system of the invention, therefore, the current source need only be dimensioned to handle the current required for a single glow igniter. The sequencing control can be effected by a program, especially by a microprocessor program if desired.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
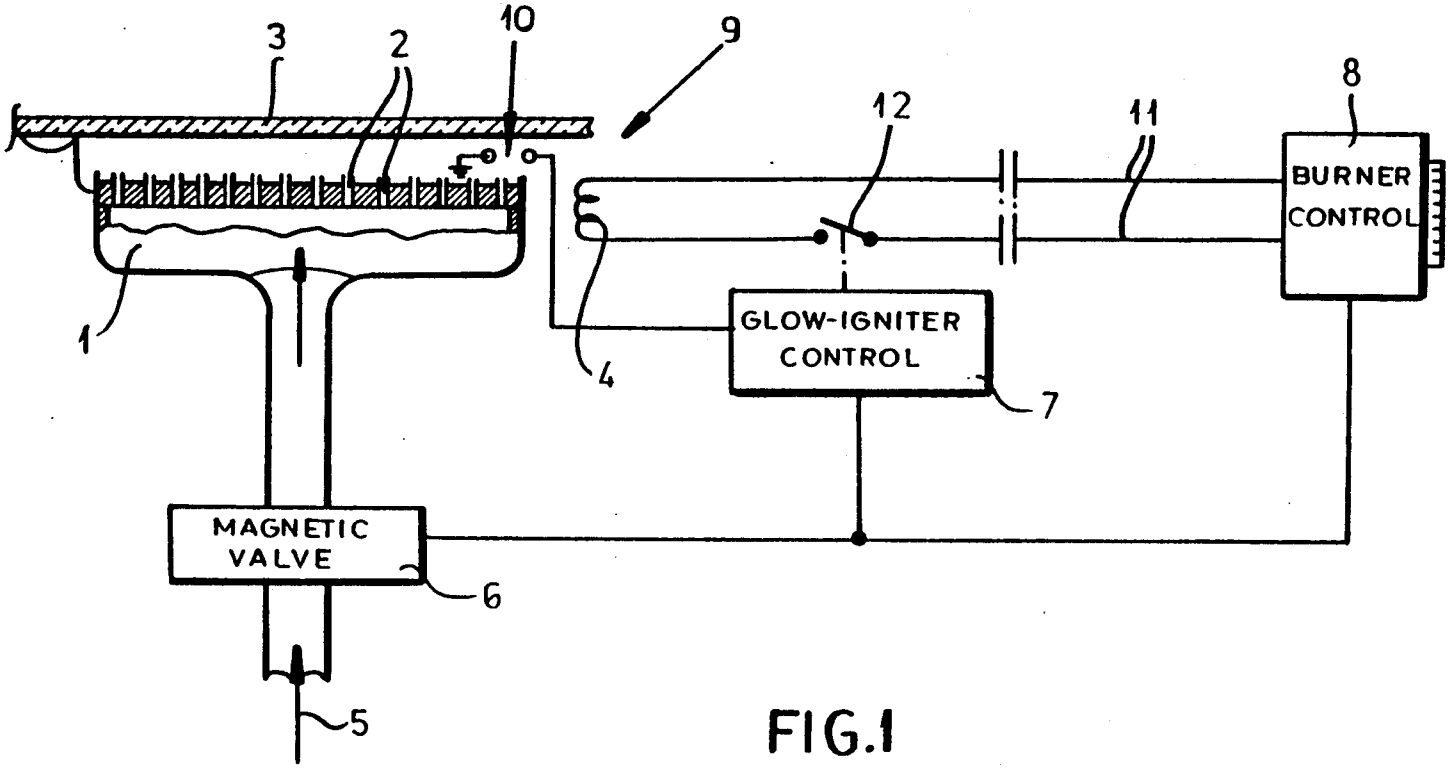
FIG. 1 is a cross sectional view in highly diagrammatic form of one cooking field of a gas range according to the invention.
Figure 2:
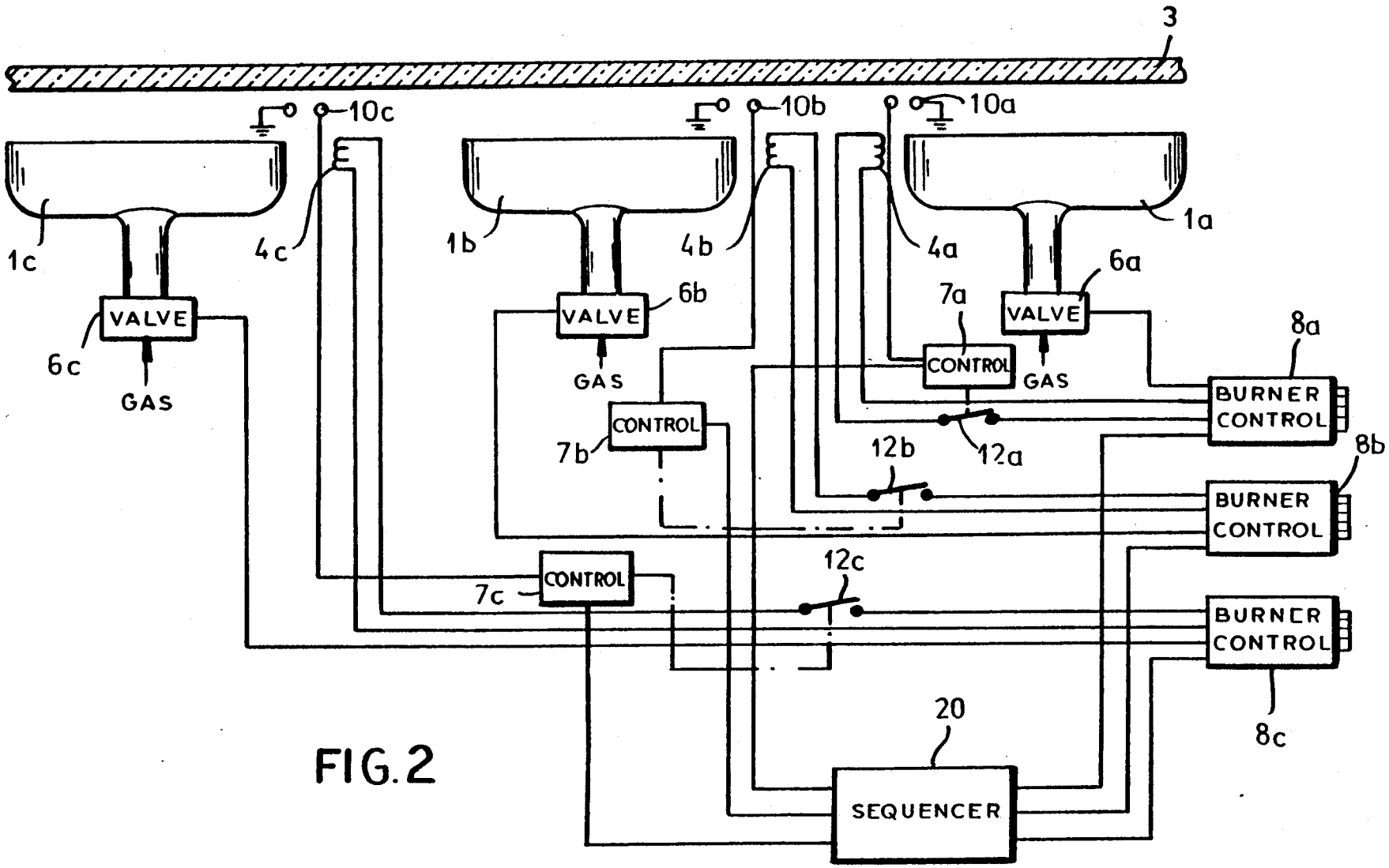
FIG. 2 is a view similar to FIG. 1 illustrating an embodiment having three cooking fields and in which the respective burners can be energized substantially simultaneously to bring into play the sequencing system described.

The range shown diagrammatically in FIG. 1 has a single glass-ceramic cooking field although generally such a range will have a number of cooking fields arrayed side-by-side or both side-by-side and one behind another, as in the example, represented diagrammatically in FIG. 2. The glass-ceramic cooking field has a gas jet burner 1 with a nozzle plate 2 through the orifices of which a fuel gas such as neutral gas or propane can emerge to be combusted in the usual manner.

Above the burner 1, a glass-ceramic plate 3 is provided and serves to receive the cooking vessel. In the region of the nozzle plate 3 and close to the burner 1, a glow-type igniter 4 is provided, the glow igniter, for example, including a ceramic support on which a coil forming a resistance heater is mounted so that this coil will glow at a temperature above the cooking temperature of the fuel gas when energized in a conventional manner.

A gas supply 5 feeds the fuel gas through a magnetic valve 6 to the burner 1 and a device for turning the burner on and off is provided at 8 and can have a dial or other indicator signalling the burner status.

According to the invention, a control unit 7 is provided which can be connected to the burner control 8 and which, in turn, is provided with a monitoring device 9 for monitoring the status of the gas jet burner 1, i.e. whether the burner is sustaining the flame or not. The gas supply device 5 is indicated only by an arrow and can be any source of a fuel gas.

The monitoring device 9 operates with an ionization stretch 10, detecting ionization produced by combustion gases generated by the burner. Such ionization stretches or detectors are widely used for flame monitoring and the detection of combustion products, e.g. in smoke detectors and fire-warning devices.

The ionization sensor 10 provides a control signal to the glow igniter controller 7. The glow igniter 4 is incorporated in a circuit 11 which can be turned on and off with the burner control 8 as illustrated, this circuit having further an interrupter, represented by a switch 12, which is operated to interrupt the circuit in response to the glow igniter controller 7 when the ionization sensor 10 detects ionization from combustion gases.

Thus, when the burner control 8 is turned on, the magnetic valve 6 is operated to feed fuel gas to the burner and the switch 12 is in its closed position so that the glow igniter 4 is energized as well. A nonexplosive ignition can then occur and once ignition does occur and the burner begins to produce combustion products, ionization is detected by the sensor 10 to cause the glow igniter controller to open the switch 12 and thereby de-energize the glow igniter 4 and prevent excessive heating thereof.

The circuit of FIG. 2 operates similarly except that burners 1a–1c are provided for reflective cooking fields on the glass-ceramic plate 3 and are fed by respective electromagnetic valves 6a–6c operated by burner controls 8a–8c and having glow igniters 4a–4c which work into respective controllers 7a–7c in the manner described. In addition, however, a sequencing unit 20 is provided which can be operated under microprocessor control in accordance with a program or by hard-wire timing sequencing so that the switches 12a, 12b, 12c will be closed in succession, reopened in response to the detection of ionization and in such order that a subsequent switch will close only after a preceding switch has opened.

As a consequence, the igniters can only be energized in succession and the current feed for the system need only be dimensioned for the current demand of a single igniter. Otherwise each burner operates in the manner described. The sequencer 20 is responsive to the burner controls 8a–8c and is only effective when two or more burners are turned on simultaneously.

We claim:

1. A cooking range, comprising:

a glass-ceramic plate forming at least one cooking field;

a fuel-gas burner disposed below said glass-ceramic plate and having an orifice plate spaced below and juxtaposed with said glass-ceramic plate for producing gas jet which are combustible to heat said cooking field and produce combustion gas;

a magnetic valve controlling flow of fuel gas to said burner;

a burner control connected to said magnetic valve for turning said burner ON and OFF;

a glow-type igniter disposed proximal to said orifice plate and energizable to ignite said gas jets;

a glow-igniter circuit connected to said glow-type igniter and energizable by said burner control upon turning said burner ON;

monitoring means responsive to combustion at said burner for controlling said igniter, said monitoring means including;

an ionization sensor disposed proximal to said orifice plate and responsive to ionization in said combustion gas, and means operatively connected to said ionization sensor for interrupting said circuit upon a response of said ionization sensor to ionization in said combustion gas; and wherein a plurality of cooking fields are provided and said cooking fields have respective burners, magnetic valves, sensors and igniters, said cooking range further comprising sequencing means connected to said igniters for energizing an $n^{th}$ igniter only after an $(n-1)^{th}$ igniter has ignited its respective burner and has been turned off, n being an integer greater than 1.

2. The cooking range defined in claim 1 wherein said means operatively connected to said ionization sensor for interrupting said circuit upon a response of said ionization sensor to ionization in said combustion gas is a switch in series with said igniter.

* * * * *